United States Patent [19]

Genjida et al.

[11] 3,992,312

[45] Nov. 16, 1976

[54] NON-INFLAMMABLE HYDRAULIC FLUID

[75] Inventors: Fumihide Genjida; Motohiko Ii; Toyoaki Nasuno, all of Kyoto, Japan

[73] Assignee: Sanyo Chemical Industries, Ltd., Kyoto, Japan

[22] Filed: Aug. 5, 1975

[21] Appl. No.: 601,998

[30] Foreign Application Priority Data

Aug. 6, 1974 Japan ..... 49-90368

[52] U.S. Cl. ..... 252/77; 252/493; 252/51.5 A

[51] Int. Cl.[2] ..... C10M 3/30

[58] Field of Search ..... 252/77, 75, 51.5 A, 252/49.3

[56] References Cited

UNITED STATES PATENTS

| | | | |
|---|---|---|---|
| 2,455,961 | 12/1948 | Walker | 252/75 |
| 2,462,694 | 2/1949 | Walker | 252/75 |
| 3,005,776 | 10/1961 | Langer et al. | 252/77 |
| 3,806,456 | 4/1974 | Vogel | 252/77 X |

*Primary Examiner*—Pitlick, Harris A.
*Attorney, Agent, or Firm*—Oblon, Fisher, Spivak, McClelland & Maier

[57] ABSTRACT

A water-glycol base hydraulic fluid comprises a water soluble alkylene oxide adduct of a polyamide.

12 Claims, No Drawings by condensing the polycarboxylic acid and the polyamine. The molecular weight of the resulting polyamide is not critical. It is generally 500 – 5,000, preferably 1,000 – 3,000. It is preferred in this invention that the polyamide contain many active hydrogen atoms is its molecule, because such a polyamide, when it is reacted with alkylene oxides, forms a water soluble polymer having a large molecular weight, which has good lubricating and wear reducing qualities and is relatively non-toxic to fish. Thus, the number of active hydrogen atoms in the polyamide is preferably at least 8, more preferably 8 to 40. The number of active hydrogen atoms may be easily controlled for example, by appropriately selecting the raw materials and the amounts to be used. For example, the polyamide which is prepared by condensing 2 moles of dimer acid with 3 moles of pentaethylenehexamine has 20 active hydrogen atoms in its molecule, and the polyamide from 5 moles of adipic acid and 6 moles of pentaethylenehexamine has 38 active hydrogen atoms in its molecule.

The other moiety which constitutes the water soluble polymer in this invention is the oxyalkylene group comprising both oxylethylene groups and other oxyalkylene groups. The introduction of these groups into the polymer is generally made by adding alkylene oxides to the polyamide as in conventional methods. Examples of the alkylene oxides other than ethylene oxide are propylene oxide, butylene oxides, tetrahydrofuran and styrene oxide, preferably propylene oxide. The introduction of oxyalkylene groups may also be made by other conventional methods. For example, polyoxyalkylene glycol can be produced from the alkylene oxide in the first step; the glycol is changed into a halide; and then the halide is reacted with the polyamide. In this case, when the polyamide has carboxylic groups, the above glycol may be esterified directly with the polyamide. In another method, the introduction of oxyalkylene groups may be made before the polyamide is produced. Thus, a polyamine partially acylated is reacted with alkylene oxides, and then the resultant intermediate is condensed with a polycarboxylic acid.

In any method, the resultant polymer may contain free active hydrogen atoms which remain unreacted with the alkylene oxides.

The oxyethylene groups and the other oxyalkylene groups may be present in any order, e.g. in random or block form. The ratio of the amount of the oxyethylene groups (A) to that of the other oxyalkylene groups (B) is not critical. It is preferably 50(A) : 50(B) — 90 : 10 by weight, depending upon the water solubility and properties of the liquid state involved.

The molecular weight of the water soluble polymer is generally 10,000 – 200,000, preferably 50,000 – 150,000. If the value exceeds 200,000, the polymer will be solid and the solubility in water will decrease. Moreover, the production of the polymer will be difficult. On the other hand, a molecular weight of less than 10,000 is unsatisfactory from the viewpoint of the resultant viscosity and toxicity to fish. In this invention, the molecular weight is determined by the hydroxyl value of the polymer.

The above-mentioned water soluble polymer is used as one of the components of a water-glycol base hydraulic fluid. The resultant hydraulic fluids of this invention comprise (1) water, (2) the above water soluble polymer (thickener) and (3) a glycol (viscosity modifier). The above polymer may be used in the mixture with a conventional thickener such as polyoxyalkylene polyols. The weight ratio of the three components should be as follws:

1. water — 30 – 60% (preferably 35 – 50%);
2. the polymer — 5 – 30% (preferably 10 – 20%); and
3. glycol — 15 – 60% (preferably 30 – 50%)

The hydraulic fluids of this invention may also contain other components as in conventional fluids. Suitable formulations of the fluid of this invention with such additives are as follows:

| | % by weight |
|---|---|
| (1) Water | 35 – 50 |
| (2) Water soluble polymer of this inventon | 12 – 17 |
| (3) Viscosity modifier (or pour point depressant) | 25 – 50 |
| (4) Oiliness improver | 0 – 15 (Preferably 1 – 10) |
| (5) Rust inhibitor | 0 – 7 (Preferably 0.1 – 5) |
| (6) pH conditioner | 0 – 2 |
| (7) Foam inhibitor | 0 – 1 |
| (8) Antioxidant | 0 – 2 |
| (9) Dye | 0 – 0.1 |
| (10) Sequestering agent | 0 – 0.1 |

In the above formulation, the pour point depressants or viscosity modifiers include glycols having 2 to 12 carbon atoms such as ethylene glycol, diethylene glycol, triethylene glycol, propylene glycol, tripropylene glycol and mixtures thereof. The oiliness improvers include aliphatic or aromatic carboxylic acids (preferably having at least 6 carbon atoms) such as caprilic acid, oleic acid, dimer acids, benzoic acid, dimethyl benzoic acid, and alkali metal or organic amine salts thereof (such as of morpholine). Rust inhibitors include monoethanolamine, diethanolamine, triethanolamine, ethylenediamine, diethylenetriamine, cyclohexylamine, morpholine, 1,4-bis(2-aminoethyl)pyperadine, 2-heptadecyl-1-(2-hydroxyethyl)imidazoline, derivatives thereof (alkylene oxide addition products), alkali metal salts of carboxylic acids (carboxylic acids are the same as those for the oiliness improvers mentioned above) and cyclohexylamine nitrite. In some cases, amine or alkali metal salts of the carboxylic acids (the amines and carboxylic acids are the same as those mentioned for the rust inhibitor and oiliness improvers, respectively) may serve both as the rust inhibitor and the oiliness improver. pH conditioners include the organic amines as mentioned for the rust inhibitors, and alkali metal hydroxides. In some cases, oiliness improvers or rust inhibitors may also be used as the pH conditioner. Foam inhibitors include silicones of the emulsion type. Antioxidants include benzotriazole, mercaptobenzoimidazole and mercaptobenzotriazole. The dyes include basic dyes and acid dyes. The sequestering agents include aminocarboxylic acids (and derivatives thereof, especially metal salts thereof) such as ethylenediaminetetraacetic acid, diethylenetriaminepentaacetic acid, sodium or copper salts thereof, and oxycarboxylic acids (and derivatives thereof, especially metal salts thereof) such as tartaric acid and sodium gluconate. There may also be used mixtures of these compounds.

The water soluble polymer of this invention may be also used as a component of a hydraulic fluid of an emulsion type.

The fluids of this invention containing the water soluble polymer have good lubricating and wear preventing

NON-INFLAMMABLE HYDRAULIC FLUID

BACKGROUND OF THE INVENTION

1. Field of the Invention

This invention relates to an improved non-inflammable hydraulic fluid having a water-glycol base. It further relates to a hydraulic fluid of the type mentioned having superior lubricating or wear preventing qualities.

2. Description of the Prior Art

In the prior art, numerous hydraulic fluids have been proposed. Some of these are of the mineral oil type which are advantageous in their good lubricating and anti-wear properties, but which are rather highly inflammable and thereby unsuitable for certain uses. For example, in factories, such as iron works, in which machinery is often operated at high temperatures, the hydraulic fluids used to control the machinery have frequently been a source of fire and danger. For this reason, there is a growing demand for non-inflammable hydraulic fluids, and mineral oil type fluids are gradually being converted to non-inflammable types.

Conventional non-inflammable hydraulic fluids are mainly classified into three groups - phosphate esters; w/o (water in oil) emulsions; and water-glycol base fluids. The phosphate esters have good anti-wear qualities, but have a high cost and have the further disadvantage in that it is difficult to treat waste fluids derived from their use. While the w/o emulsions are relatively inexpensive, they tend to separate into their constituent components during use, and also tend to suffer deterioration of some of their properties due to the propagation of bacteria. Moreover, they have a poor wear reducing property.

Water-glycol fluids commonly have high non-inflammability, good stability and a relatively low cost. The water-glycol fluids, however, have poor anti-wear characteritics. Moreover, the fluids are deteriorated by metal dust resulting from metal wear thereby causing serious difficulties. For example, when conventional water-glycol hydraulic fluids are used in hydraulic devices, e.g. vane pumps, designed and manufactured for use with mineral oil hydraulic fluids, the result is significant wear of the cam ring [which is made of ball-bearing steel (relatively soft steel)] under mild conditions (i.e., a fluid temperature of 50° C and 70Kg/cm$^2$ or less of pressure). In extreme cases, the ring is worn an amount in excess of 1,000mg. While wear of the vanes [which are made of high speed steel (harder than ball-bearing steel)] is relatively minor, the fluids do tend to form deposits at the head of the vanes. Furthermore, metal dust or sludge resulting from wear tend to deposit onto the filter, thereby decreasing its capacity. Some will also tend to disperse into the fluids themselves making them turbid. Such metal dust or sludge catalyze the oxidation of the fluids whereby the resultant oxidized fluid is characterized by poorer wear-preventing qualities.

In the past, there have been various attempts to improve the poor lubricating properties or poor wear-prevention properties of these fluids. For example, one method was to modify the polyalkylene polyol which is often added to conventional water-glycol fluids. Another technique was to incorporate into these fluids such conventional additives as oil improvers, E.P. agents, rust inhibitors and sequestering agents. However, none of these methods were effective for their intended purposes. As a result, a need continues to exist for water-glycol fluids which have good lubricating properties.

SUMMARY OF THE INVENTION

Accordingly, one object of this invention is to provide non-inflammable hydraulic fluids having a water-glycol base which have improved overall properties.

Another object of this invention is to provide non-inflammable hydraulic fluids having a water-glycol base which have superior lubricating properties.

Yet another object of this invention is to provide non-flammable hydraulic fluids of a water-glycol base having good wear preventing properties.

Briefly, these and other objects of this invention as hereinafter will become more readily apparent by the ensuing discussion have been attained broadly by providing an improved non-flammable hydraulic fluid of a water-glycol base comprising a water soluble polymer wherein said polymer contains a polyamide residue having active hydrogen atoms, which residue is bonded to oxyalkylene groups comprising at least 2 moles of oxyethylene groups and at least 2 moles of another oxyalkylene groups.

DESCRIPTION OF THE PREFERRED EMBODIMENTS

In this invention, the water soluble polymer is a polymer having (1) a residue of a polyamide having active hydrogen atoms, and (2) oxyalkylene groups bonded to the residue. "The polyamide residue having active hydrogen atoms" refers to the group obtained by eliminating at least one hydrogen atom from a polyamide.

Suitable polyamides include the condensation product of a polycarboxylic acid and a polyamine. Suitable polycarboxylic acids include, for example, saturated or unsaturated aliphatic polycarboxylic acids (such as oxalic acid, malonic acid, succinic acid, glutaric acid, adipic acid, maleic acid, fumaric acid, glutaconic acid and butenetricarboxylic acid); aromatic polycarboxylic acids (such as phthalic acid, terephthalic acid, isophthalic acid and trimellitic acid); polymerized fatty acids (dimer acids); oxy-carboxylic acids (such as malic acid and tartaric acid); and keto-dicarboxylic acids (such as acetonedicarboxylic acid). The preferred polycarboxylic acids are polymerized fatty acids, and saturated aliphatic acids, such as oxalic acid, malonic acid, succinic acid and adipic acid. Polymerized fatty acids are most preferred. The expression "polycarboxylic acid" as used herein includes derivatives of the same such as lower alkyl ($C_1 - C_4$) esters, amides, acid halides, anhydrides and salts (alkali metal, alkaline earth metal or lower alkyl amine salts) thereof.

Suitable polyamines include, for example, aliphatic polyamines (such as ethylenediamine, diethylenetriamine, triethylenetetramine, tetraethylenepentamine, pentaethylenehexamine, propylenediamine, butylenediamine, and xylylenediamine) and aromatic polyamines (such as tolylene diamine and diaminodiphenylmethane). The preferred polyamines are polyalkylene polyamines such as tetraethylenepentantamine and pentaethylenehexamine. Pentaethylenehexamine is most preferred. The expression "polyamine" as used herein includes derivatives such as the polyamine salts of inorganic or organic acids and lower acyl ($C_1 - C_4$) polyamines.

The polyamide may be produced from the above polycarboxylic acid and polyamine by any known conventional method. Thus, it may be generally produced qualities. Furthermore, the fluids of this invention possess the various characteristics which are required in a water-glycol hydraulic fluid such as fire-resistance, water solubility, favorable viscosity parameters and low foaming properties. Moreover, the fluids of this invention have such good stability that they do not become turbid even after long operation in hydraulic devices.

The water-glycol hydraulic fluids of this invention are also useful for transmission of energy in hydraulic devices such as hot rolling equipment, various furnaces in iron works, presses such as die casting equipment, conveyors, cranes and forklift trucks.

Having genrally described this invention, a further understanding can be obtained by reference to certain specific examples which are provided herein for purposes of illustration only and are not intended to be limiting unless otherwise specified.

EXAMPLE 1 (The water soluble polymers)

1. polymer A 118.1g (0.2 mole) of dimer acid (acid value: 190) and 69.9g (0.3 mole) of pentaethylenehexamine were placed in an autoclave and heated at 150° – 160° C for about 8 hours. The resulting water was removed. Then, 16g of potassium hydroxide was added at 100°]– 120° C and the resulting water was removed. Thereafter, 16,180g of a mixture of ethylene oxide (EO) and propylene oxide (PO) (80 : 20 weight %) was introduced into the autoclave gradually to obtain 16,370g of a water soluble polymer A of this invention (average molecular weight: 85,000).

2. Polymer B

The procedure for producing Polymer A (Procedure A) was repeated except that 13,870g of the mixture of EO and PO (80 : 20 weight %) was used. 14,060g of a water soluble polymer B of this invention was obtained (average molecular weight: 75,000).

4. Polymer D

The procedure for producing Polymer C was repeated except that 6,900g of the mixture of EO and PO (85 : 15 weight %) was used. 6,990g of the water soluble polymer D of this invention was obtained (average molecular weight: 52,000).

5. Polymer E

Procedure A was repeated except that 29,820g of the mixture of EO and PO (80 :20 weight %) was used. 30,010g of the water soluble polymer E of this invention was obtained (average molecular weight: 145,000).

6. Polymer F (Conventional component)

Polyoxyalkylene glycol (average molecular weight: 15,000) was prepared by adding a mixture of EO and PO (75 : 25 weight %) to 1,6-hexanediol.

7. Polymer G (conventional component)

Polyoxyalkykene glycol (average molecular weight: 3,000) was prepared by adding a mixture of EO and PO (65 : 35 weight %) to glycerine.

EXAMPLE 2 (Test of the lubricity to metal)

Test of the lubricity to metal was conducted with each of the polymers (polymers A-E) of this invention in comparison with the conventional polymers F and G. Lubricity to metal (coefficient of friction, $\mu$) was measured by the Shell 4 - ball E.P. (Extreme Pressure) Lubricant Tester, using an aqueous solution of the test polymer in a concentration of 1 and 5 wt. % under the conditions of 600 rpm (revolution speed) and 40, 60, 80 and 100Kg load.

The results are given in Table 1. They show that the polymers of this invention (polymers A–E) are superior to the conventional polymers (polymers F and G) in lubricity to metal.

TABLE I

| Concentration (% by weight) | Load (Kg) | Coefficient of Friction | | | | | | |
|---|---|---|---|---|---|---|---|---|
| | | Polymer A | Polymer B | Polymer C | Polymer D | Polymer E | Polymer F (conventional) | Polymer G (conventional) |
| 1 | 40 | 0.464 | 0.445 | 0.453 | 0.483 | 0.430 | 0.524 | 0.524 |
| | 60 | 0.346 | 0.338 | 0.348 | 0.402 | 0.328 | 0.442 | 0.464 |
| | 80 | 0.314 | 0.310 | 0.315 | 0.350 | 0.302 | 0.382 | 0.382 |
| | 100 | 0.300 | 0.288 | 0.295 | 0.322 | 0.272 | 0.350 | 0.364 |
| 5 | 40 | 0.382 | 0.369 | 0.375 | 0.424 | 0.368 | 0.464 | 0.464 |
| | 60 | 0.318 | 0.305 | 0.311 | 0.338 | 0.300 | 0.375 | 0.382 |
| | 80 | 0.310 | 0.291 | 0.302 | 0.322 | 0.287 | 0.358 | 0.355 |
| | 100 | 0.300 | 0.282 | 0.287 | 0.310 | 0.278 | 0.345 | 0.345 |

3. Polymer C

Procedure A was repeated except that 29.2g (0.2 mole) of adipic acid (replacement for the dimer acid) and 69.6g (0.3 mole) of pentaethylenehexamine were used. 15,510g of the water soluble polymer C of this invention was obtained (average molecular weight: 84,000).

EXAMPLE 3 (Formulations of water-glycol hydraulic fluids)

According to the formulations shown in Table 2, water-glycol hydraulic fluids (Fluids A–E) of this invention were prepared using polymers A – E of Example 1. For comparison, conventional water-glycol hydraulic fluids (Fluids F and G) were also prepared using polymers F and G of Example 1.

TABLE 2

| Fluids / Components | Fluid A | Fluid B | Fluid C | Fluid D | Fluid E | Fluid F (conventional) | Fluid G (conventional) |
|---|---|---|---|---|---|---|---|
| Water | 430* | 430 | 430 | 400 | 470 | 430 | 430 |
| Polymer A | 140 | | | | | | |
| Polymer B | | 140 | | | | | |
| Polymer C | | | 140 | | | | |
| Polymer D | | | | 170 | | | |

TABLE 2-continued

| Fluids / Components | Fluid A | Fluid B | Fluid C | Fluid D | Fluid E | Fluid F (conventional) | Fluid G (conventional) |
|---|---|---|---|---|---|---|---|
| Polymer E | | | | | 110 | | |
| Polymer F (conventional) | | | | | | 140 | |
| Polymer G (conventional) | | | | | | | 140 |
| Glycol** | 360 | 360 | 360 | 360 | 360 | 360 | 360 |
| Morpholine or potassium salt of oleic acid | 75 | 75 | 75 | 75 | 75 | 75 | 75 |
| Foam inhibitor | 2 | 2 | 2 | 2 | 2 | 2 | 2 |
| Antioxidant | 2 | 2 | 2 | 2 | 2 | 2 | 2 |
| Sequestering agent | 0.3 | 0.3 | 0.3 | 0.3 | 0.3 | 0.3 | 0.3 |
| Total | 1009.3 | 1009.3 | 1009.3 | 1009.3 | 1009.3 | 1009.3 | 1009.3 |

*parts by weight
**a mixture of diethylene glycol (DEG) and ethyleneglycol (EG) (DEG:EG — 5:1 by weight)

EXAMPLE 4 (Pump tests of the water-glycol hydraulic fluids)

Pump tests of the hydraulic fluids of Example 3 were carried out by the method of ASTM D 2882-70T. Operational conditions were as follows:

| | | |
|---|---|---|
| (a) | Hydraulic pump | Vickers V-104-E vane pump |
| (b) | Fluid quantity | 40 liters |
| (c) | Relief valve pressure | 70 Kg/cm² |
| (d) | Pump shaft speed | 1,200 rpm |
| (e) | Fluid temperature at pump inlet | 50° C |

The results are given in Table 3, which shows that the hydraulic fluids of this invention (Fluids A–E) are superior to the conventional hydraulic fluids (Fluids F and G) in anti-wear qualities (cam ring and vanes), sludge preventing qualities and stability of the fluids (appearance of the fluid) after the pump test.

TABLE 3

| Test time (hrs.) | | Fluid A | Fluid B | Fluid C | Fluid D | Fluid E | Fluid F (conventional) | Fluid G (conventional) |
|---|---|---|---|---|---|---|---|---|
| 50 | Cam ring wear (mg) | 2.4 | 0.7 | 1.5 | 11.3 | 0.7 | 221.1 | 393.8 |
| | Vanes wear (mg) | 1.4 | 1.8 | 2.0 | 3.1 | 1.5 | 28.0 | 5.1 |
| | Sludge preventing quality* | Good | Good | Good | Good | Good | Fair | Poor |
| | Appearance of the fluid** (after pump test) | Good | Good | Good | Good | Good | Good | Good |
| 100 | Cam ring wear (mg) | 2.5 | 1.2 | 1.8 | 13.7 | 1.1 | 224.7 | 603.2 |
| | Vanes wear (mg) | 1.7 | 1.9 | 2.3 | 4.8 | 1.7 | 40.1 | 7.3 |
| | Sludge preventing quality* | Good | Good | Good | Good | Good | Fair | Fair |
| | Appearance of the fluid** (after pump test) | Good | Good | Good | Good | Good | Good | Fair |

*Sludge preventing quality
Good: No sludge
Fair: A little sludge
Poor: Much sludge
**Appearance of the fluid
Good: No change and no turbidity
Fair: A little turbidity
Poor: Much change and much turbidity EXAMPLE 5 (Pump tests of the water-glycol hydraulic fluids)

Pump tests were repeated in the same manner as in Example 4 except that the test periods were 100, 250 and 500 hrs.

The results are given in Table 4.

TABLE 4

| Test time (hrs.) | | Hydraulic fluid A | Hydraulic fluid F (conventional) |
|---|---|---|---|
| 100 | Cam ring wear (mg) | 2.5 | 224.7 |
| | Vanes wear (mg) | 1.7 | 40.1 |
| | Sludge preventing quality* | Good | Fair |
| | Appearance of the fluid** (after pump test) | Good | Good |
| 250 | Cam ring wear (mg) | 2.8 | 303.4 |
| | Vanes wear (mg) | 1.7 | 52.5 |
| | Sludge preventing quality* | Good | Fair |
| | Appearance of the fluid** (after pump test) | Good | Good |
| 500 | Cam ring wear (mg) | 2.9 | 341.9 |
| | Vanes wear (mg) | 1.8 | 593 |
| | Sludge preventing quality* | Good | Fair |
| | Appearance of the fluid** (after pump test) | Good to Fair | Good to Fair |

* and ** are the same as in Table 3.

Table 5 shows that the hydraulic fluid of this invention (Fluid A) is superior to the conventional hydraulic fluid (Fluid F) in anti-wear qualities (cam ring and vanes), sludge preventing qualities and stability of the fluid (appearance of the fluid after the pump test).

Having now fully described the invention, it will be apparent to one of ordinary skill in the art that many changes and modifications can be made thereto without departing from the spirit or scope of the invention as set forth herein.

What is claimed as new and desired to be secured by Letters Patent is:

1. A non-inflammable hydraulic fluid of a water-glycol base which comprises 5–30% of a water soluble polymer having an average molecular weight of from 10,000 – 200,000 wherein said polymer contains a polyamide residue having active hydrogen atoms which residue is bonded to oxyalkylene groups comprising at least 2 moles of oxyethylene groups and at least 2 moles of other oxyalkylene groups, 30–60% of water and 15–60% of a glycol.

2. The non-inflammable hydraulic fluid of a water-glycol base of claim 1, wherein the polyamide is a condensation product of an aliphatic polycarboxylic acid and a polyalkylene polyamine.

3. The non-inflammable hydraulic fluid of a water-glycol base of claim 2, wherein the aliphatic polycarboxylic acid is a polymerized fatty acid or adipic acid.

4. The non-inflammable hydraulic fluid of a water-glycol base of claim 2, wherein the polyalkylene polyamine is tetraethylene pentamine, pentaethylenehexamine or mixtures thereof.

5. The non-inflammable hydraulic fluid of a water-glycol base of claim 1, wherein the molecular weight of the polyamide is 500 – 5,000.

6. The non-inflammable hydraulic fluid of a water-glycol base of claim 1, wherein the polyamide has 8 - 40 active hydrogen atoms.

7. The non-inflammable hydraulic fluid of a water-glycol base of claim 1, wherein said other oxyalkylene group is a oxypropylene group.

8. The non-inflammable hydraulic fluid of a water-glycol base of claim 1, wherein the weight ratio of oxyethylene groups (a) to the other oxyalkylene groups (B) is 50 (A) : 50 (B) — 90 : 10.

9. The non-inflammable hydraulic fluid of a water-glycol base of claim 1 wherein the glycol has 2 to 12 carbon atoms.

10. The non-inflammable hydraulic fluid of a water-glycol base of claim 1, where at least one conventional additive selected from the group consisting of viscosity modifiers, oiliness improvers, rust inhibitors, pH conditioners, foam inhibitors, antioxidants, dyes and sequestering agents is incorporated into the fluid.

11. The non-inflammable hydraulic fluid of a water-glycol base of claim 10, wherein the conventional additive is an oiliness improver, a rust inhibitor, an antioxidant, a dye, a sequestering agent or a mixture thereof.

12. The method of lubricating and preventing wear in a hydraulic device which comprises using the fluid of claim 1 as the hydraulic fluid for the device.

* * * * *